US011536432B2

(12) United States Patent
Sugihara et al.

(10) Patent No.: US 11,536,432 B2
(45) Date of Patent: Dec. 27, 2022

(54) LIGHTING TOOL FOR VEHICLE

(71) Applicant: STANLEY ELECTRIC CO., LTD., Tokyo (JP)

(72) Inventors: Yuki Sugihara, Tokyo (JP); Shota Nishimura, Tokyo (JP); Shinya Hoshino, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/372,232

(22) Filed: Jul. 9, 2021

(65) Prior Publication Data

US 2022/0018511 A1 Jan. 20, 2022

(30) Foreign Application Priority Data

Jul. 20, 2020 (JP) ..... JP2020-123629

(51) Int. Cl.

| | |
|---|---|
| ***F21S 41/25*** | (2018.01) |
| ***F21S 41/143*** | (2018.01) |
| ***F21S 45/47*** | (2018.01) |
| *F21W 102/135* | (2018.01) |

(52) U.S. Cl.

CPC ..... *F21S 41/25* (2018.01); *F21S 41/143* (2018.01); *F21S 45/47* (2018.01); *F21W 2102/135* (2018.01)

(58) Field of Classification Search

None

See application file for complete search history.

(56) References Cited

U.S. PATENT DOCUMENTS

| | | | | |
|---|---|---|---|---|
| 2016/0369966 | A1* | 12/2016 | Kuwata | F21S 41/151 |
| 2017/0292671 | A1 | 10/2017 | Gousset-Rousseau | |
| 2019/0226658 | A1 | 7/2019 | Kawai et al. | |
| 2020/0041089 | A1 | 2/2020 | Gromfeld | |

FOREIGN PATENT DOCUMENTS

| | | | |
|---|---|---|---|
| DE | 10 2007 052 696 | A1 | 7/2008 |
| EP | 3 232 118 | A1 | 10/2017 |
| KR | 10-2020-0079863 | A | 7/2020 |
| WO | 2018/043663 | A1 | 3/2018 |

OTHER PUBLICATIONS

The extended European Search Report for the related European Patent Application No. 21185310.6 dated Dec. 15, 2021.

* cited by examiner

*Primary Examiner* — Elmito Breval

(74) *Attorney, Agent, or Firm* — Kenealy Vaidya LLP

(57) ABSTRACT

A projection lens has a first lens body including a first incidence section disposed at a side facing a first light source and an emitting section disposed at a side opposite to the first incidence section, and a second lens body including a second incidence section disposed at a side facing a second light source, a structure in which the first lens body and the second lens body abut against each other in between first boundary surfaces, which are provided between the emitting section and the second incidence section, and second boundary surfaces, which are provided between the first incidence section and the second incidence section from a boundary line with respect to the first boundary surfaces is provided, and the first boundary surfaces and the second boundary surfaces are disposed at an acute angle including the boundary line therebetween.

12 Claims, 9 Drawing Sheets

LIGHTING TOOL FOR VEHICLE

CROSS-REFERENCE TO RELATED APPLICATION

Priority is claimed on Japanese Patent Application No. 2020-123629, filed Jul. 20, 2020, the content of which is incorporated herein by reference.

BACKGROUND OF THE INVENTION

Field of the Invention

The present invention relates to a lighting tool for a vehicle.

Description of Related Art

For example, a lighting tool for a vehicle such as a headlight for a vehicle (headlamp) or the like includes a light source, a reflector configured to reflect light emitted from the light source in a direction in which the vehicle advances, a shade configured to shield (cut) some of the light reflected by the reflector, and a projection lens configured to project the light, some of which is cut by the shade, in the direction in which the vehicle advances.

In such a lighting tool for a vehicle, when a light source image defined by a front end of the shade is reversed and projected by the projection lens as a passing beam (low beam), a light distribution pattern for a low beam including a cutoff line is formed on an upper end of the shade.

In addition, in the lighting tool for a vehicle, when another light source configured to emit light in the direction in which the vehicle advances is disposed below the shade and light emitted from the light source is projected by the projection lens as a traveling beam (high beam), a light distribution pattern for a high beam is formed above the light distribution pattern for a low beam.

Incidentally, in a lighting tool for a vehicle disclosed in PCT International Publication No. WO2018/043663, instead of the above-mentioned reflector and shade, forming a light distribution pattern for a low beam and a light distribution pattern for a high beam using two light guide members provided to correspond to two upper and lower light sources is proposed.

SUMMARY OF THE INVENTION

However, in the lighting tool for a vehicle disclosed in PCT International Publication No. WO2018/043663, since an air layer (air gap) is present between the two light guide members, efficiency of utilization of the light emitted from the light source is decreased due to Fresnel loss generated therebetween. In addition, the light distribution pattern may vary due to a variation in positional accuracy (in particular, an interval between the air gaps) of the two light guide members. Further, when the light is totally reflected between an upper surface of the lower light guide member and the air layer, a defect (a dark section) may occur on the side of a lower section of the light distribution pattern for a high beam.

In addition, in the lighting tool for a vehicle disclosed in PCT International Publication No. WO2018/043663, the two light guide members, which are provided to correspond to the two upper and lower light sources, overlap each other via the air layer in the upward/downward direction, and it is difficult to minimize a height dimension of the two light guide members.

The aspect of the present invention is directed to providing a lighting tool for a vehicle capable of obtaining a good light distribution pattern, minimizing a height dimension of a projection lens, and achieving an overall reduction in thickness.

In order to accomplish the above-mentioned purpose, the present invention provides the following means.

(1) A lighting tool for a vehicle including:

a first light source configured to emit first light;

a second light source that is disposed adjacent to the first light source and that is configured to emit second light in a same direction as the first light; and a projection lens configured to project the first light and the second light in a same direction, wherein the projection lens has a first lens body including a first incidence section disposed at a side facing the first light source, and an emitting section disposed at a side opposite to the first incidence section, and a second lens body including a second incidence section disposed at a side facing the second light source, a structure in which the first lens body and the second lens body abut against each other in between first boundary surfaces, which are provided between the emitting section and the second incidence section, and second boundary surfaces, which are provided between the first incidence section and the second incidence section from a boundary line with respect to the first boundary surfaces, is provided, the first boundary surfaces and the second boundary surfaces are disposed at an acute angle including the boundary line therebetween, among the first light that has entered inside of the first lens body from the first incidence section, the first light reflected at the second boundary surface is emitted from the emitting section to an outside of the first lens body, and among the second light that has entered inside of the second lens body from the second incidence section, the second light that has passed through the first boundary surface and the second light that has passed through the second boundary surface are emitted from the emitting section to the outside of the first lens body.

(2) The lighting tool for a vehicle according to the above-mentioned (1), wherein a refractive index of the second lens body is smaller than a refractive index of the first lens body.

(3) The lighting tool for a vehicle according to the above-mentioned (2), wherein a structure in which the first lens body and the second lens body abut against each other via an intermediate layer is included, and the refractive index of the second lens body is equal to or smaller than a refractive index of the intermediate layer.

(4) The lighting tool for a vehicle according to any one of the above-mentioned (1) to (3), wherein the emitting section has a lens surface configured to condense the first light and the second light in a direction in which the boundary line extends and in a direction in which the first light source and the second light source are aligned.

(5) The lighting tool for a vehicle according to any one of the above-mentioned (1) to (3), wherein the projection lens has a third lens body disposed at a side opposite to the emitting section, the emitting section has a lens surface configured to condense the first light and the second light in a direction in which the boundary line extends, and the third lens body has a lens surface configured to condense the first light and the second light emitted from the emitting section in a direction in which the first light source and the second light source are aligned.

(6) The lighting tool for a vehicle according to the above-mentioned (5), wherein the third lens body is integrally assembled to the first lens body in a state in which an air layer is provided between the emitting section and the third lens body.

(7) The lighting tool for a vehicle according to any one of the above-mentioned (1) to (6), wherein the first light source and the second light source are provided on a same surface of the same substrate.

(8) The lighting tool for a vehicle according to any one of the above-mentioned (1) to (7), wherein the first light projected by the projection lens forms a first light distribution pattern including a cutoff line defined by the boundary line on an upper end thereof, and the second light projected by the projection lens forms a second light distribution pattern disposed above the first light distribution pattern.

According to the aspect of the present invention, it is possible to provide a lighting tool for a vehicle capable of obtaining a good light distribution pattern, minimizing a height dimension of a projection lens, and achieving an overall reduction in the thickness.

DETAILED DESCRIPTION OF THE INVENTION

Figure 1:
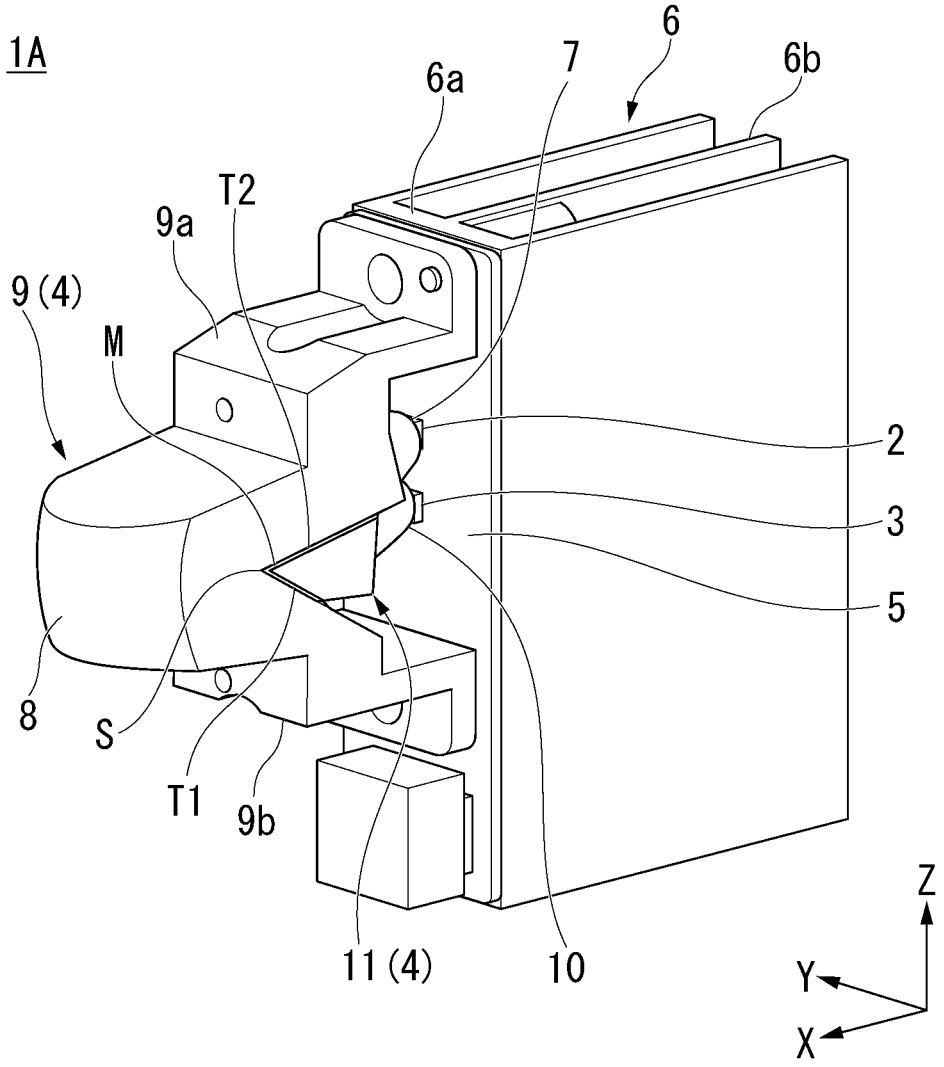
FIG. 1 is a perspective view showing a configuration of a lighting tool for a vehicle according to a first embodiment of the present invention.

Hereinafter, embodiments of the present invention will be described in detail with reference to the accompanying drawings.

Further, in the drawings used in the following description, in order to make components easier to see, scales of dimensions may be shown differently depending on the components, and dimensional ratios or the like of the components are not always the same as the actual ones.

In addition, in the drawings described below, an XYZ orthogonal coordinate system is set, an X-axis direction indicates a forward/rearward direction (a lengthwise direction) of a lighting tool for a vehicle, a Y-axis direction indicates a leftward/rightward direction (a widthwise direction) of the lighting tool for a vehicle, and a Z-axis direction indicates an upward/downward direction (a height direction) of the lighting tool for a vehicle.

First Embodiment

First, as a first embodiment of the present invention, for example, a lighting tool 1A for a vehicle shown in FIG. 1 to FIG. 5 will be described.

Figure 2:
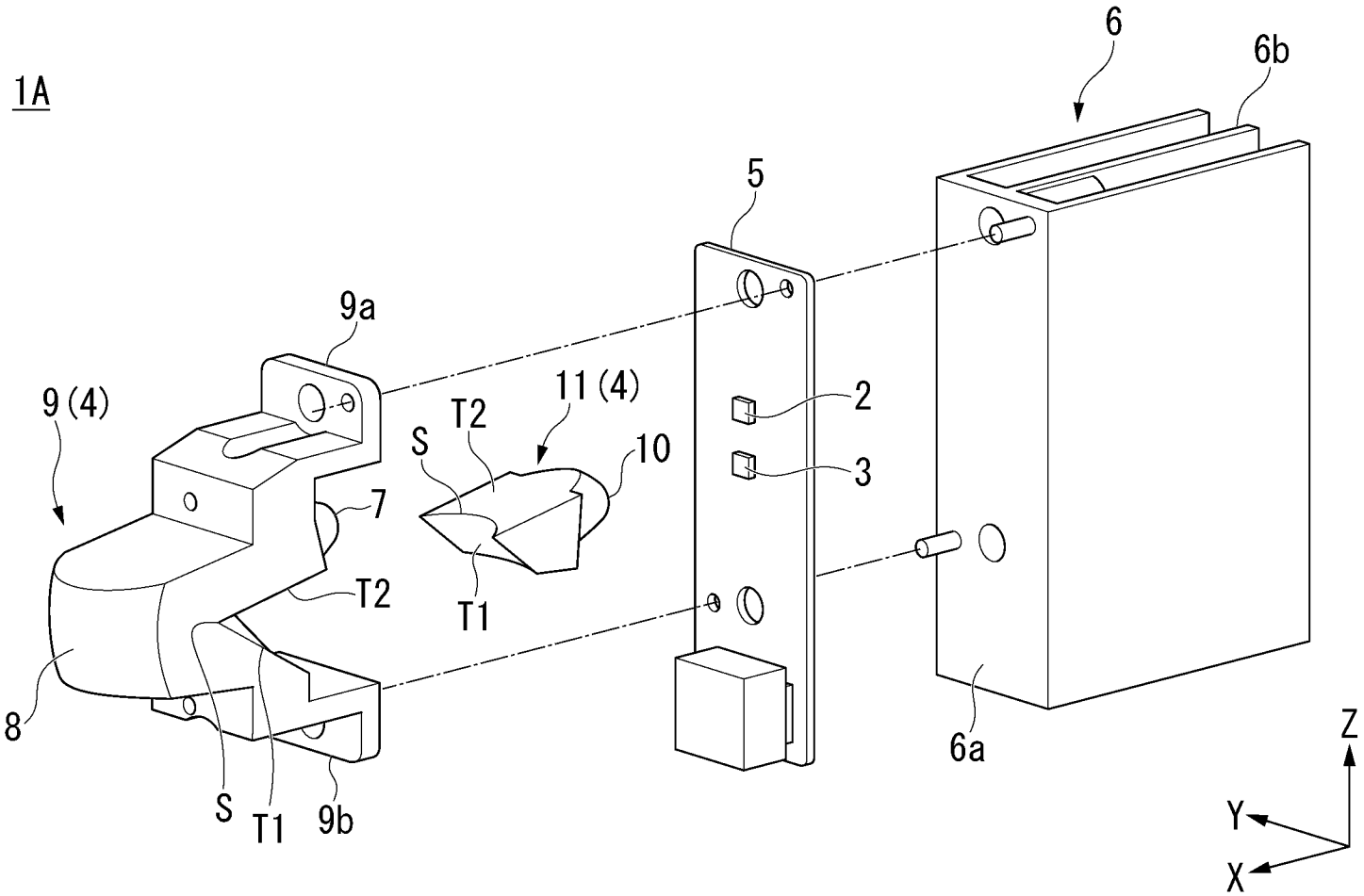
FIG. 2 is an exploded perspective view showing the configuration of the lighting tool for a vehicle shown in FIG. 1.
Figure 3:
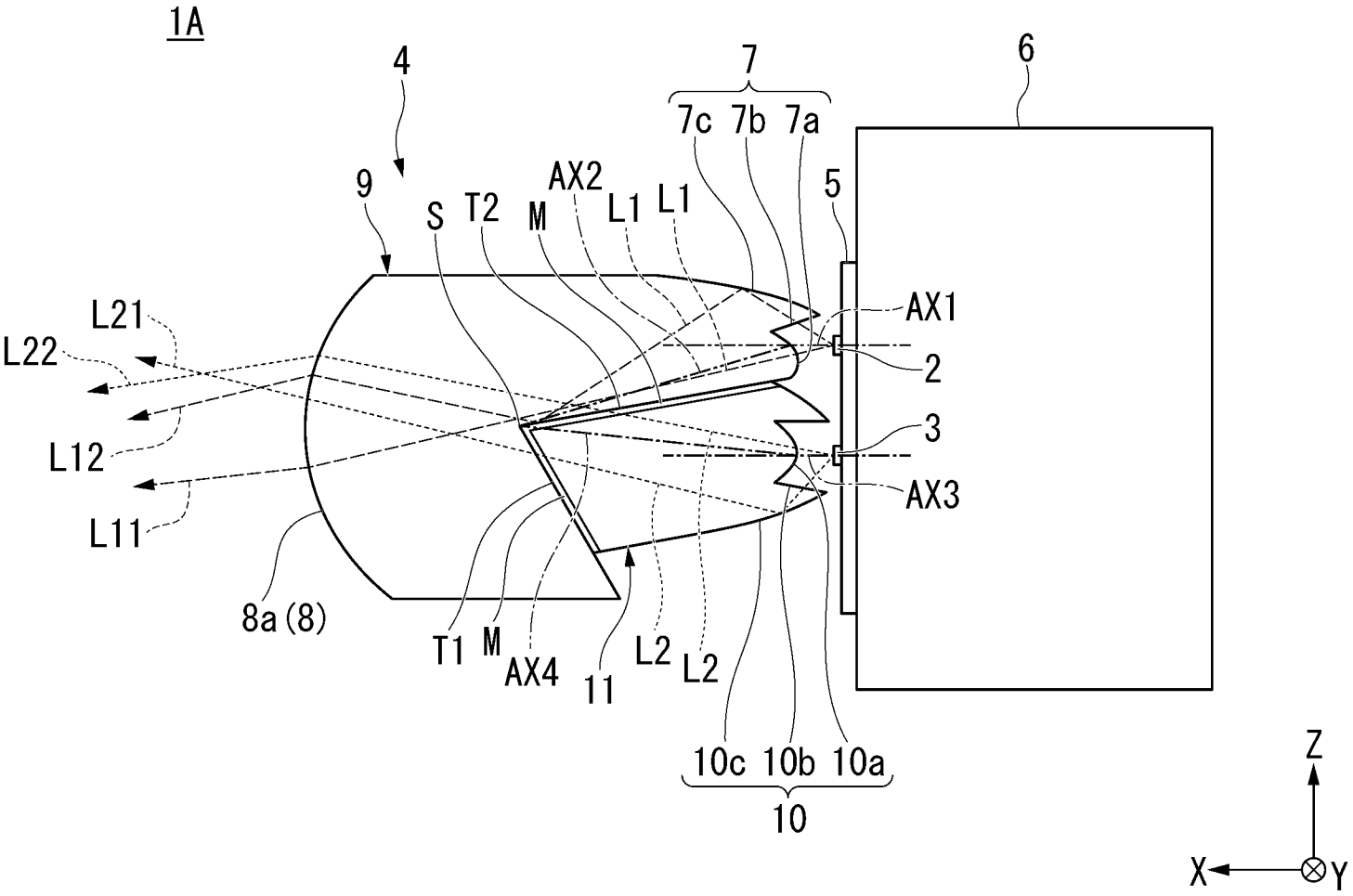
FIG. 3 is a vertical cross-sectional view showing the configuration of the lighting tool for a vehicle shown in FIG. 1.
Figure 4:
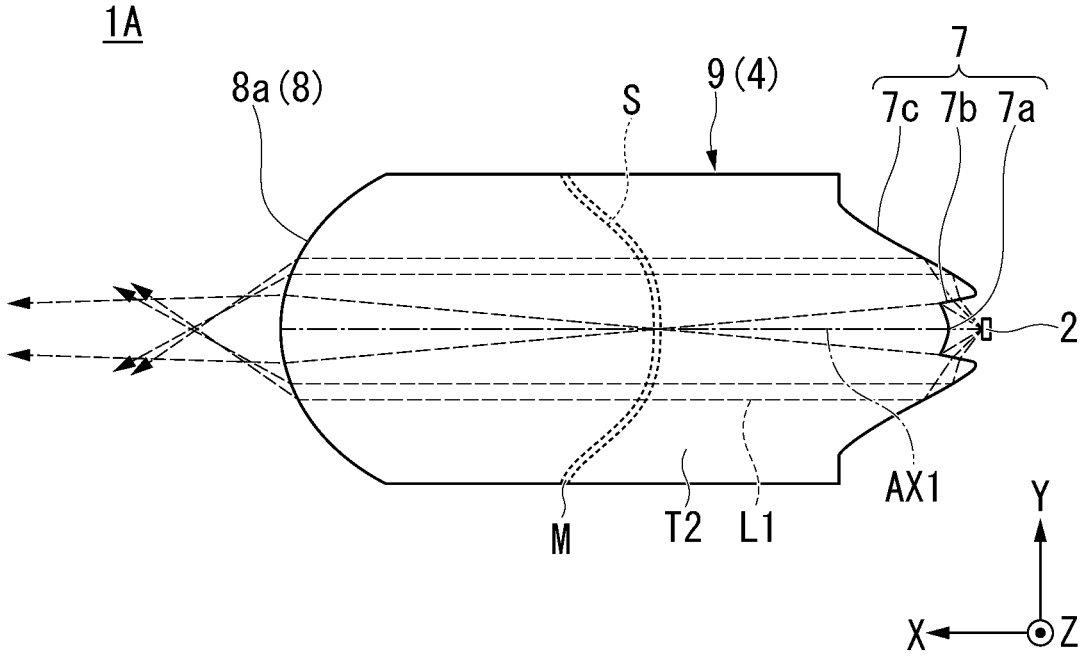
FIG. 4 is a horizontal cross-sectional view of the configuration of the lighting tool for a vehicle shown in FIG. 1 on the side of a first incidence section.
Figure 5:
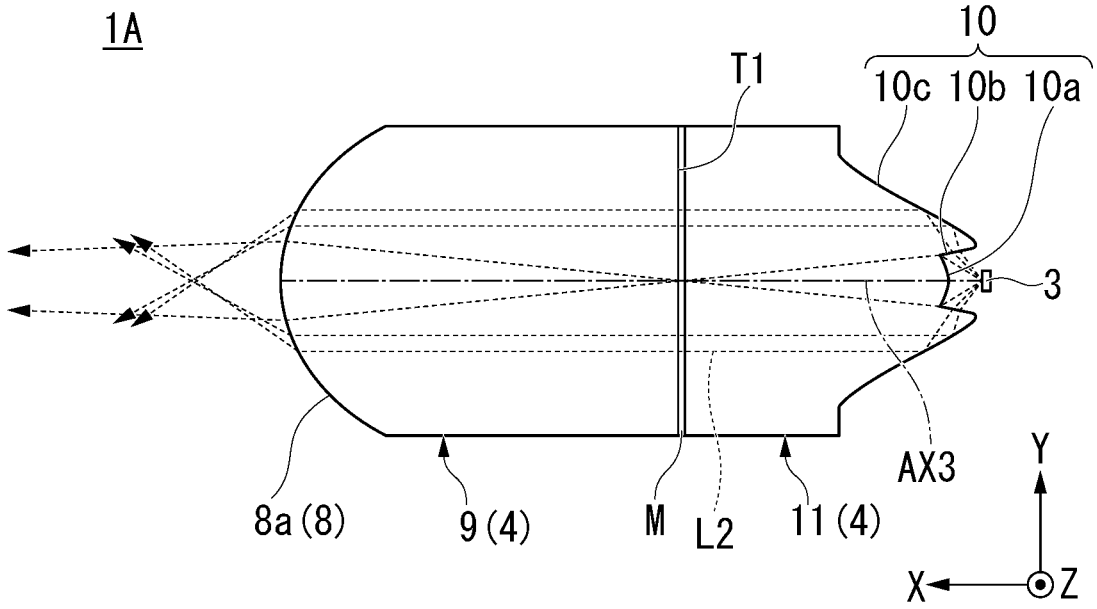
FIG. 5 is a horizontal cross-sectional view showing the configuration of the lighting tool for a vehicle shown in FIG. 1 on the side of a second incidence section.

Further, FIG. 1 is a perspective view showing a configuration of the lighting tool 1A for a vehicle. FIG. 2 is an exploded perspective view showing the configuration of the lighting tool 1A for a vehicle. FIG. 3 is a vertical cross-sectional view showing the configuration of the lighting tool 1A for a vehicle. FIG. 4 is a horizontal cross-sectional view showing the configuration of the lighting tool 1A for a vehicle on the side of a first incidence section 7. FIG. 5 is a horizontal cross-sectional view showing the configuration of the lighting tool 1A for a vehicle on the side of a second incidence section 10.

The lighting tool 1A for a vehicle of the embodiment is a headlight for a vehicle (headlamp) in which the present invention is applied, and is configured to emit a passing beam (low beam) that forms a light distribution pattern for a low beam including a cutoff line on an upper end thereof and a traveling beam (high beam) that forms a light distribution pattern for a high beam above the light distribution pattern for a low beam toward a front of the vehicle (in a +X-axis direction) in a switchable manner.

Specifically, as shown in FIG. 1 to FIG. 5, the lighting tool 1A for a vehicle generally includes a first light source 2 configured to emit first light L1, a second light source 3 configured to emit second light L2, and a projection lens 4 configured to project the first light L1 and the second light L2, at inside of a lighting body (not shown).

Further, the lighting body is constituted by a housing, a front surface of which is opened, and a transparent lens cover configured to cover an opening of the housing. In addition, a shape of the lighting body can be appropriately changed according to a design or the like of the vehicle.

The first light source 2 and the second light source 3 are constituted by, for example, light emitting diodes (LEDs) that emit white light. In addition, a high output (high brightness) type LED for vehicle illumination (for example, an SMD LED or the like) may be used. Further, in the first light source 2 and the second light source 3, in addition to the above-mentioned LED, for example, a light emitting element such as a laser diode (LD) or the like can be used.

In the lighting tool 1A for a vehicle of the embodiment, the first light source 2 and the second light source 3 are aligned adjacent to each other in a vertical direction (an upward/downward direction) of the lighting tool 1A for a vehicle. Among them, one LED that constitutes the first light source 2 is disposed on an upper side, and one LED that constitutes the second light source 3 is disposed on a lower side.

The first light source 2 and the second light source 3 are mounted on the side of one surface (in the embodiment, a front surface) of a circuit substrate 5 on which a driving circuit configured to drive the LEDs is provided. Accordingly, the first light source 2 and the second light source 3 radially emit the first light L1 and the second light L2 toward a front side (a side of a +X axis). That is, the first light source 2 and the second light source 3 are provided on the same surface of the same circuit substrate 5, and radially emit the first light L1 and the second light L2 in the same direction.

In addition, a heat sink 6 configured to radiate heat emitted from the first light source 2 and the second light source 3 is attached to the side of the other surface (in the embodiment, a back surface) of the circuit substrate 5. The heat sink 6 is constituted by an extruded molding body formed of a metal having a high thermal conductivity such as aluminum or the like. The heat sink 6 has a base section 6*a* in contact with the circuit substrate 5, and a plurality of fin sections 6*b* configured to increase dissipation of heat transmitted from the circuit substrate 5 to the base section 6*a*.

Further, while the configuration in which the LEDs that constitute the first light source 2 and the second light source 3, and the driving circuit configured to drive the LEDs are mounted on the circuit substrate 5 is provided in this embodiment, a configuration in which a mounting substrate on which LEDs are mounted and a circuit substrate on which a driving circuit configured to drive the LEDs are provided are disposed separately, the mounting substrate and the circuit substrate are electrically connected to each other via a wiring cord referred to as a harness, and thus the driving circuit is protected from heat emitted from the LEDs may be provided.

The projection lens 4 has a first lens body 9 including the first incidence section 7 disposed at a side opposite to the first light source 2 and an emitting section 8 disposed at a side opposite to the first incidence section 7, and a second lens body 11 including the second incidence section 10 disposed at a side opposite to the second light source 3.

In the projection lens 4, a refractive index of the second lens body 11 is smaller than a refractive index of the first lens body 9. In the embodiment, for example, the first lens body 9 is formed of a polycarbonate resin (PC), and the second lens body 11 is formed of an acryl resin (PMMA).

Further, the combination of materials having different refractive indices of the first lens body 9 and the second lens body 11 is not necessarily limited to such a combination, and may be appropriately changed. In addition, the material is not limited to the above-mentioned resins having optical transparency, and glass may also be used.

The projection lens 4 has a structure in which the first lens body 9 and the second lens body 11 abut against each other via an intermediate layer M in between first boundary surfaces T1, which are provided between the emitting section 8 and the second incidence section 10, and second boundary surfaces T2, which are provided between the first incidence section 7 and the second incidence section 10 from a boundary line S with respect to the first boundary surfaces T1.

The intermediate layer M is formed of a binding material with optical transparency that joins the first lens body 9 and the second lens body 11. In addition, a thickness of the intermediate layer M may be a thickness sufficient to join the first lens body 9 and the second lens body 11.

In the projection lens 4, a refractive index of the intermediate layer M is smaller than a refractive index of the first lens body 9. In addition, a refractive index of the second lens body 11 is equal to or smaller than the refractive index of the intermediate layer M. That is, the refractive index of the second lens body 11 is the same as the refractive index of the intermediate layer M, or the refractive index of the intermediate layer M is greater than the refractive index of the second lens body 11.

Meanwhile, when making a difference (a critical angle) between the refractive indices of the first lens body 9 and the intermediate layer M great, it is preferable to use the intermediate layer M having a value close to the refractive index of the second lens body 11. A binding material that satisfies such a condition can be appropriately selected from known binding materials and can be used for the intermediate layer M.

The first boundary surface T1 is constituted by a surface that divides between the first lens body 9 and the second lens body 11 downward from the boundary line S, and is inclined diagonally rearward from the boundary line S. The second boundary surface T2 is constituted by a surface that divides between the first lens body 9 and the second lens body 11 rearward from the boundary line S, and is inclined diagonally upward from the boundary line S.

Accordingly, the first boundary surface T1 and the second boundary surface T2 are disposed at an acute angle including the boundary line S therebetween. The boundary line S defines a cutoff line of the above-mentioned light distribution pattern for a low beam while extending in the horizontal direction (the leftward/rightward direction) of the lighting tool 1A for a vehicle.

The first lens body 9 and the second lens body 11 are joined to each other via the intermediate layer M, which serves as a binding material, without having the air layer present between the first boundary surfaces T1 and between the second boundary surfaces T2 by abutting the respective first boundary surface T1 and the respective second boundary surface T2 against each other via the intermediate layer M.

In addition, the first lens body 9 has a pair of arm sections 9*a* and 9*b*. The pair of arm sections 9*a* and 9*b* are provided to extend rearward from both of upper and lower sides of the first lens body 9. In addition, tip sides of the pair of arm sections 9*a* and 9*b* have shapes that are bent away from each other.

In the projection lens 4, the pair of arm sections 9*a* and 9*b* are fixed to a fixed position such as a bracket or the like in the lighting body by fastening screws together with the circuit substrate 5. Accordingly, the first lens body 9 and the second lens body 11 are positioned and fixed to the first light source 2 and the second light source 3 while intervals between the first light source 2 and the second light source 3 and between the first incidence section 7 and the second incidence section 10 are maintained.

The first incidence section 7 has a first condensing incidence surface 7*a* having a convex surface shape, disposed at a portion opposite to the first light source 2 and on which some of the first light L1 emitted from the first light source 2 is incident, a second condensing incidence surface 7*b* having a substantially cylindrical shape, disposed on an inner circumferential side of a portion protruding from a position around the first condensing incidence surface 7*a* toward the first light source 2 and on which some of the first light L1 emitted from the first light source 2 is incident, and a condensing reflecting surface 7*c* having a truncated conical shape, disposed on an outer circumferential side of the protruding portion and configured to reflect the first light L1 incident from the second condensing incidence surface 7*b*.

In addition, since the first incidence section 7 is adjacent to the second incidence section 10 while having the second boundary surface T2 sandwiched therebetween, the first incidence section 7 has a shape in which parts on the lower sides of the first condensing incidence surface 7*a*, the second condensing incidence surface 7*b* and the condensing reflecting surface 7*c* are cut out along the second boundary surface T2.

In the first incidence section 7, among the first light L1 radially emitted from the first light source 2, the first light L1 entering inside of the first lens body 9 from the first condensing incidence surface 7*a* is condensed closer to an optical axis. Meanwhile, the first light L1 entering inside of the first lens body 9 from the second condensing incidence surface 7*b* is reflected at the condensing reflecting surface 7*c* and condensed closer to the optical axis.

Accordingly, the first light L1 entering inside of the first lens body 9 from the first incidence section 7 is guided toward a front of the first lens body 9 while being condensed closer to an optical axis AX2, which is inclined downward diagonally than an optical axis AX1 of the first light L1 emitted from the first light source 2, in the vertical cross section of the lighting tool 1A for a vehicle shown in FIG. 3.

Meanwhile, the first light L1 entering inside of the first lens body 9 from the first incidence section 7 is guided toward a front of the first lens body 9 while being parallelized with respect to the optical axis AX1 of the first light L1 in the horizontal cross section of the lighting tool 1A for a vehicle shown in FIG. 4. Further, regarding the first incidence section 7, in the horizontal cross section of the lighting tool 1A for a vehicle, a configuration in which the first light L1 enters inside of the first lens body 9 while being condensed closer to the optical axis AX1 may be used.

In addition, the first light L1 entering inside of the first lens body 9 from the first incidence section 7 is guided toward the emitting section 8 in front of the first lens body 9. Among this first light L1, the first light L1 that incident on the second boundary surface T2 is guided toward the emitting section 8 after being reflected at the second boundary surface T2.

That is, in the second boundary surface T2, since the refractive index of the intermediate layer M made to be smaller than the refractive index of the first lens body 9, the first light L1 incident on the second boundary surface T2 can be totally reflected toward the emitting section 8.

The second incidence section 10 has a first condensing incidence surface 10*a* having a convex surface shape, disposed at a portion opposite to the second light source 3 and on which some of the second light L2 emitted from the second light source 3 is incident, a second condensing incidence surface 10*b* having a substantially cylindrical shape, disposed on an inner circumferential side of a portion protruding from a position around the first condensing incidence surface 10*a* toward the second light source 3 and on which some of the second light L2 emitted from the second light source 3 is incident, and a condensing reflecting surface 10*c* having a truncated conical shape, disposed on an outer circumferential side of the protruding portion and configured to reflect the second light L2 incident from the second condensing incidence surface 10*b*.

In the second incidence section 10, among the second light L2 emitted from the second light source 3, the second light L2 entering inside of the second lens body 11 from the first condensing incidence surface 10*a* is condensed closer to the optical axis. Meanwhile, the second light L2 entering inside of the second lens body 11 from the second condensing incidence surface 10*b* is reflected by the condensing reflecting surface 10*c* and is condensed closer to the optical axis.

Accordingly, the second light L2 entering inside of the second lens body 11 from the second incidence section 10 is guided toward a front of the second lens body 11 while being condensed closer to an optical axis AX4, which is inclined upward diagonally than an optical axis AX3 of the second light L2 emitted from the second light source 3, in the vertical cross section of the lighting tool 1A for a vehicle shown in FIG. 3.

Meanwhile, the second light L2 entering inside of the second lens body 11 from the second incidence section 10 is guided forward from the second lens body 11 while being parallelized with respect to the optical axis AX3 of the second light L2 in the horizontal cross section of the lighting tool 1A for a vehicle shown in FIG. 5. Further, in the second incidence section 10, in the horizontal cross section of the lighting tool 1A for a vehicle, a configuration in which the second light L2 enters inside of the second lens body 11 while being condensed closer to the optical axis AX3 may be used.

In addition, the second light L2 entering inside of the second lens body 11 from the second incidence section 10 passes through the first boundary surface T1 and the second boundary surface T2 in front of the second lens body 11 and enters inside of the first lens body 9. The second light L2 entering inside of the first lens body 9 is guided toward the emitting section 8.

That is, in the first boundary surface T1 and the second boundary surface T2, since the refractive index of the intermediate layer M and the second lens body 11 are made smaller than the refractive index of the first lens body 9, the second light L2 incident on the first boundary surface T1 and the second boundary surface T2 can pass toward the emitting section 8.

In addition, in the second boundary surface T2, the refractive index of the intermediate layer M and the second lens body 11 are made smaller than the refractive index of the first lens body 9, and thus, the second light L2 incident on the second boundary surface T2 can pass toward in front of the emitting section 8 while being refracted downward. Accordingly, in the projection lens 4, a height dimension can be minimized, and reduction in the entire thickness can be achieved.

The emitting section 8 has an emitting surface 8*a* on the side of the front surface of the first lens body 9. The emitting surface 8*a* is constituted by a convex lens surface having a spherical shape or an aspherical shape that condenses the first light L1 and the second light L2 in the vertical direction of the lighting tool LA for a vehicle (a direction in which the first light source 2 and the second light source 3 are aligned and a horizontal direction (a direction in which the boundary line S extends). In addition, a focus of the convex lens surface is set on the boundary line S or in the vicinity thereof.

In the emitting section 8, the first light L1 and the second light L2 guided into inside of the first lens body 9 are emitted to the outside of the first lens body 9 while being condensed by the emitting surface 8*a*. In addition, in the emitting section 8, after the first light L1 and the second light L2 emitted from the emitting surface 8*a* are condensed, the first light L1 and the second light L2 are enlarged and projected toward a front of the first lens body 9 (the projection lens 4) by being diffused in the horizontal direction and the vertical direction of the lighting tool 1A for a vehicle.

Further, in the surfaces that constitute the first lens body 9 and the second lens body 11, the other surfaces that are not shown or explained can be freely designed (for example, blocking or the like) within a range in which there is no bad influence on the first light L1 and the second light L2 passing through the first lens body 9 and the second lens body 11.

In the lighting tool 1A for a vehicle of the embodiment having the above-mentioned configuration, the first light L1 emitted from the first light source 2 is projected by the projection lens 4 in the direction in which the vehicle advances as a passing beam (low beam). Here, the first light L1 projected toward the side in front of the projection lens 4 forms a light distribution pattern for a low beam (a first light distribution pattern), which includes a cutoff line defined by the boundary line S on the upper end, by reversing and projecting a light source image formed in the vicinity of the focus of the emitting surface 8*a*.

Meanwhile, in the lighting tool 1A for a vehicle of the embodiment, the first light L1 and the second light L2 emitted from the first light source 2 and the second light source 3 are projected by the projection lens 4 in the direction in which the vehicle advances as a traveling beam (high beam). Here, the second light L2 projected toward the side in front of the projection lens 4 forms a second light distribution pattern disposed above the light distribution pattern for a low beam (the first light distribution pattern). The light distribution pattern for a high beam is formed by overlapping the second light distribution pattern and a light distribution pattern for a low beam (a second light distribution pattern) formed by the first light L1.

In the lighting tool 1A for a vehicle of the embodiment, the first light L1 emitted from the above-mentioned first light source 2 enters inside of the first lens body 9 from the first incidence section 7. Here, the first light L1 entering the inside of the first lens body 9 from the first incidence section 7 is guided toward the side in front of the first lens body 9 while being condensed closer to the optical axis AX2, which is inclined downward diagonally than the optical axis AX1 of the first light L1 emitted from the first light source 2, in the vertical cross section of the lighting tool 1A for a vehicle shown in FIG. 3.

Figure 11:
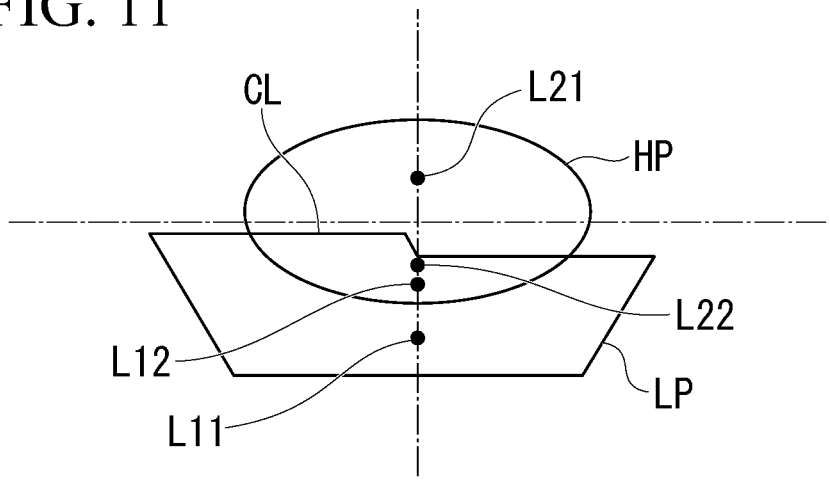
FIG. 11 is a schematic view showing a light distribution pattern for a low beam formed by first light and a light distribution pattern for a high beam formed by second light.

Among them, first light L11 guided toward the emitting section 8 is emitted from the emitting section 8 to the outside of the first lens body 9. Accordingly, the first light L11 forms a light distribution pattern below a line H-H in a light distribution pattern for a low beam LP shown in FIG. 11.

Meanwhile, first light L12 incident on the second boundary surface T2 is guided toward the emitting section 8 after being reflected at the second boundary surface T2, and is emitted from the emitting section 8 to the outside of the first lens body 9. Accordingly, the first light L12 forms a light distribution pattern at the vicinity of a cutoff line CL in the light distribution pattern for a low beam LP shown in FIG. 11.

In addition, in the lighting tool 1A for a vehicle of the embodiment, the second light L2 emitted from the above-mentioned second light source 3 enters inside of the second lens body 11 from the second incidence section 10. Here, the second light L2 entering the inside of the second lens body 11 from the second incidence section 10 is guided toward the side in front of the second lens body 11 while being condensed closer to the optical axis AX4, which is inclined upward diagonally than the optical axis AX3 of the second light L2 emitted from the second light source 3, in the vertical cross section of the lighting tool 1A for a vehicle shown in FIG. 3.

Among them, second light L21 incident on the first boundary surface T1 passes through the first boundary surface T1, is guided toward the emitting section 8 after being incident into the first lens body 9, and is emitted from the emitting section 8 to the outside of the first lens body 9. Accordingly, the second light L21 forms a light distribution pattern above the line H-H in a light distribution pattern for a high beam HP shown in FIG. 11.

Meanwhile, second light L22 incident on the second boundary surface T2 passes through the second boundary surface T2, is guided toward the emitting section 8 after being incident into the first lens body 9, and is emitted from the emitting section 8 to the outside of the first lens body 9. Accordingly, the second light L22 forms a light distribution pattern below the light distribution pattern for a high beam HP shown in FIG. 11.

In addition, the second light L22 incident on the second boundary surface T2 approaches a position or a beam angle of the first light L12 reflected by the second boundary surface T2 when passing through the second boundary surface T2. Accordingly, since the second light L22 is emitted below the cutoff line CL of the light distribution pattern for a low beam LP, a lower side of the light distribution pattern for a high beam HP shown in FIG. 11 can overlap the cutoff line CL of the light distribution pattern for a low beam LP.

As described above, in the lighting tool 1A for a vehicle of the embodiment, a good light distribution pattern for a low beam and a good light distribution pattern for a high beam can be obtained by projecting the above mentioned first light L1 and the second light L2 emitted from the first light source 2 and the second light source 3 using the projection lens 4.

In addition, in the lighting tool 1A for a vehicle of the embodiment, the first lens body 9 and the second lens body 11 that constitute the projection lens 4 are joined to each other via the intermediate layer M without having the air layer present between the first boundary surfaces T1 and between the second boundary surfaces T2 by abutting the respective first boundary surface T1 and the respective second boundary surface T2 against each other while having the intermediate layer M interposed therebetween.

Accordingly, in the lighting tool 1A for a vehicle of the embodiment, it is possible to prevent occurrence of Fresnel loss at between the first boundary surfaces T1 and at between the second boundary surfaces T2, and it is possible to increase efficiency of utilization of the first light L1 and the second light L2 emitted from the first light source 2 and the second light source 3.

Further, in the lighting tool 1A for a vehicle of the embodiment, reduction in the entire thickness can be achieved by minimizing a height dimension of the projection lens 4.

Second Embodiment

Next, for example, a lighting tool 1B for a vehicle shown in FIG. 6 to FIG. 10 will be described as a second embodiment of the present invention.

Figure 6:
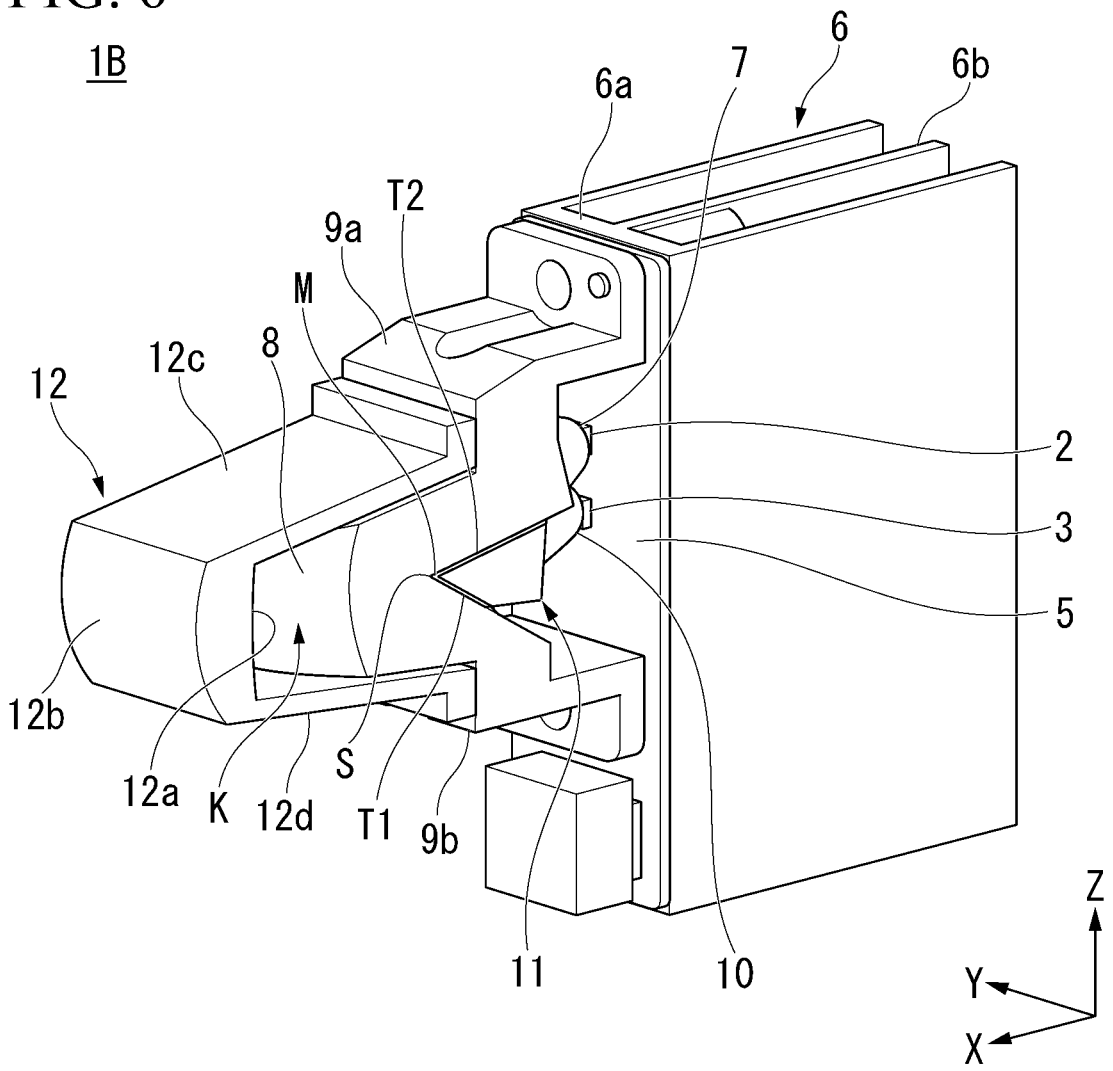
FIG. 6 is a perspective view showing a configuration of a lighting tool for a vehicle according to a second embodiment of the present invention.
Figure 7:
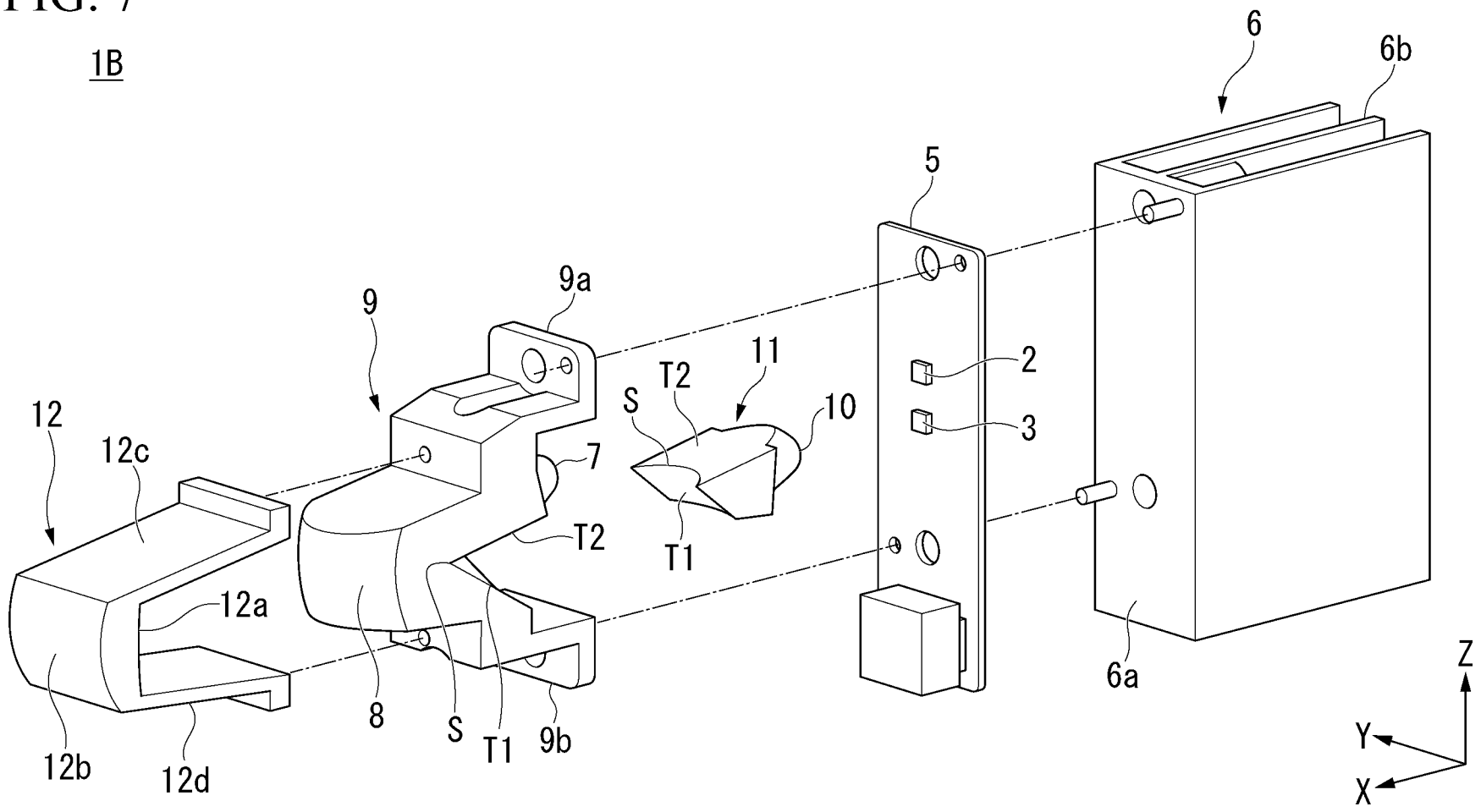
FIG. 7 is an exploded perspective view showing the configuration of the lighting tool for a vehicle shown in FIG. 6.
Figure 8:
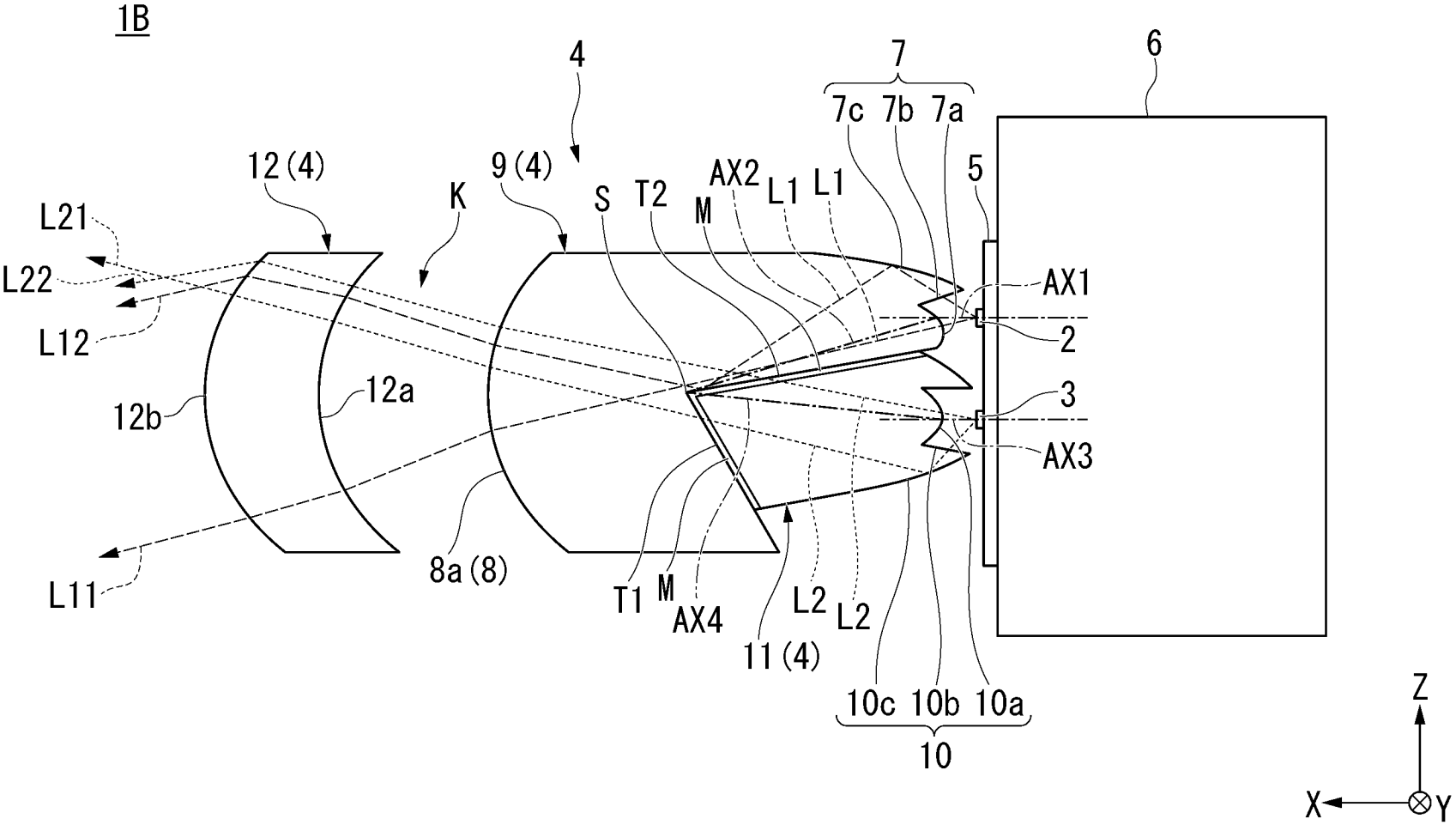
FIG. 8 is a vertical cross-sectional view showing the configuration of the lighting tool for a vehicle shown in FIG. 6.
Figure 9:
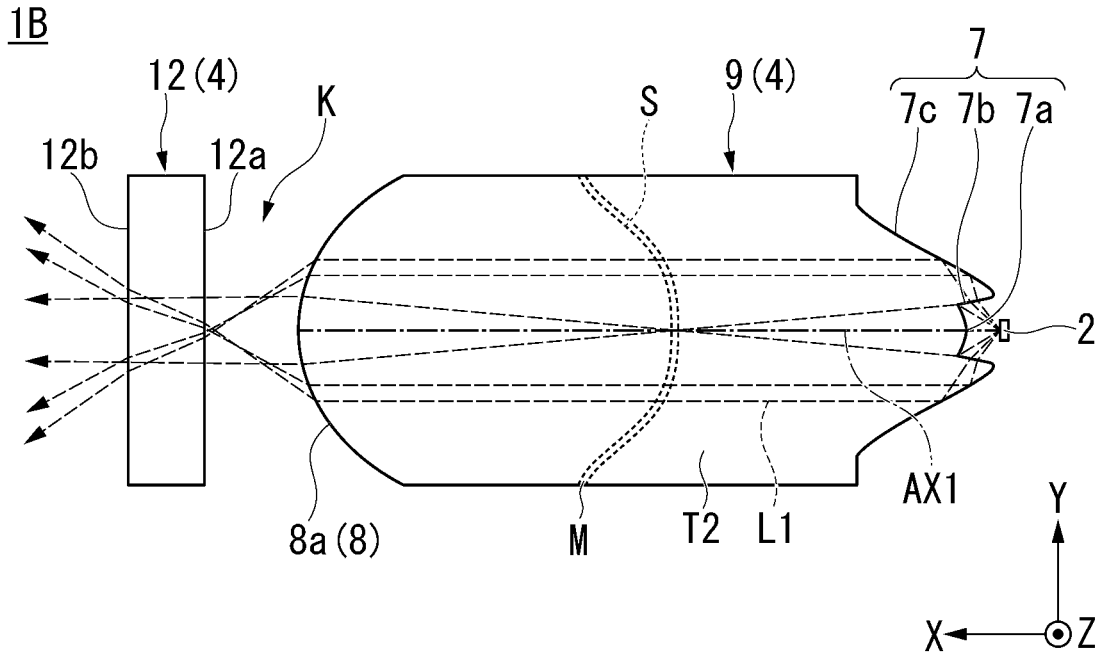
FIG. 9 is a horizontal cross-sectional view showing the configuration of the lighting tool for a vehicle shown in FIG. 6 on the side of a first incidence section.
Figure 10:
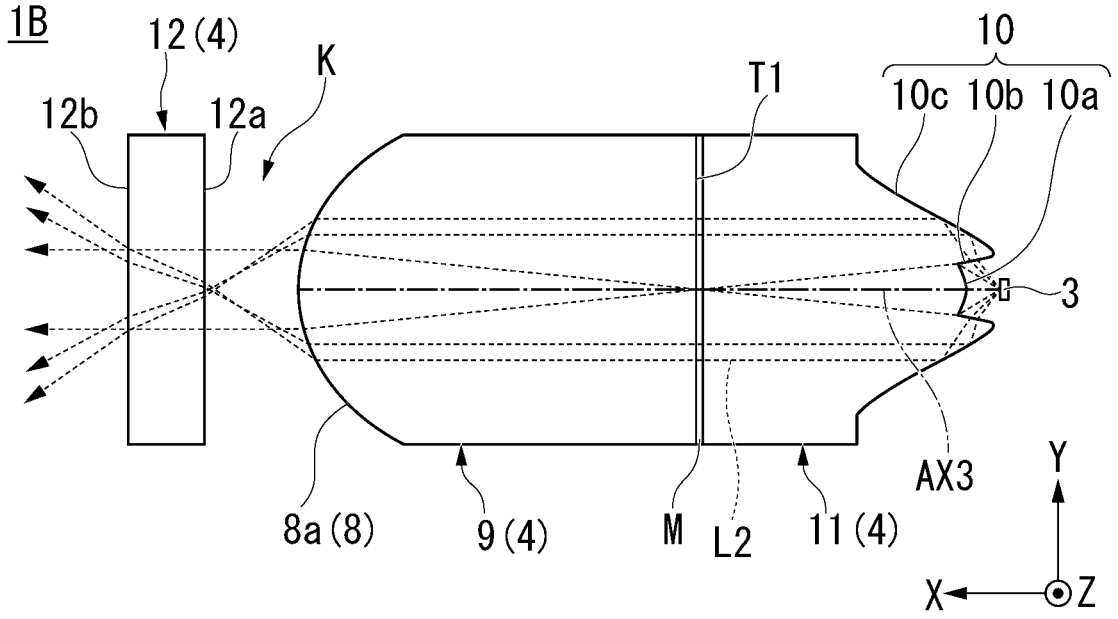
FIG. 10 is a horizontal cross-sectional view showing the configuration of the lighting tool for a vehicle shown in FIG. 6 on the side of a second incidence section.

Further, FIG. 6 is a perspective view showing a configuration of the lighting tool 1B for a vehicle. FIG. 7 is an exploded perspective view showing the configuration of the lighting tool 1B for a vehicle. FIG. 8 is a vertical cross-sectional view showing a configuration of the lighting tool 1B for a vehicle. FIG. 9 is a horizontal cross-sectional view showing the configuration of the lighting tool 1B for a vehicle on the side of the first incidence section 7. FIG. 10 is a horizontal cross-sectional view showing the configuration of the lighting tool 1B for a vehicle on the side of the second incidence section 10. In addition, in the following description, the same areas as the lighting tool 1A for a vehicle are designated by the same reference signs in the accompanying drawings while description thereof is omitted.

As shown in FIG. 6 to FIG. 10, the lighting tool 1B for a vehicle of the embodiment includes a third lens body 12 that constitutes the projection lens 4, in addition to the configuration of the lighting tool 1A for a vehicle.

That is, the projection lens 4 has the third lens body 12 disposed at a side opposite to the emitting section 8 together with the first lens body 9 and the second lens body 11.

The third lens body 12 has an incidence surface 12*a*, on which the first light L1 and the second light L2 are incident, on the side of a back surface thereof, and an emitting surface 12*b*, from which the first light L1 and the second light L2 are emitted, on the side of a front surface thereof.

The incidence surface 12*a* is constituted by a substantially semi-cylindrical convex lens surface, a cylindrical shaft of which extends in the horizontal direction, so as to condense the first light L1 and the second light L2 in the vertical direction of the lighting tool 1A for a vehicle.

The emitting surface 12*b* is constituted by a substantially semi-cylindrical convex lens surface, a cylindrical shaft of which extends in the horizontal direction, to condense the first light L1 and the second light L2 in the vertical direction of the lighting tool 1A fora vehicle.

In addition, in the lighting tool 1B for a vehicle of the embodiment, a synthetic focus of a synthetic lens constituted by the emitting surface 8*a* of the first lens body 9 and the incidence surface 12*a* and the emitting surface 12*b* of the third lens body 12 is set at the boundary line S or in the vicinity thereof.

Further, while the configuration in which the emitting section 8 has the emitting surface 8*a* that condenses the first light L1 and the second light L2 in the vertical direction and in the horizontal direction of the lighting tool 1A for a vehicle is provided, when the third lens body 12 is provided, the emitting surface 8*a* configured to condense the first light L1 and the second light L2 in the horizontal direction only of the lighting tool 1A for a vehicle may be provided.

In this case, the emitting surface 8*a* can be constituted by a substantially semi-cylindrical convex lens surface, a cylindrical shaft of which extends in the vertical direction, so as to condense the first light L1 and the second light L2 in the horizontal direction of the lighting tool 1A for a vehicle.

In addition, in the third lens body 12, the incidence surface 12*a* is not limited to be constituted by the convex lens surface, and the incidence surface 12*a* may be constituted by a flat surface.

The third lens body 12 is integrally assembled to the first lens body 9 while an air layer K is provided between the emitting section 8 and the third lens body 12. The third lens body 12 has a pair of arm sections 12*c* and 12*d*. The pair of arm sections 12*c* and 12*d* are provided to extend rearward from both of upper and lower sides of the third lens body 12. In addition, tip sides of the pair of arm sections 12*c* and 12*d* have a shape folded in a direction in which they are separated from each other.

In the projection lens 4, the pair of arm sections 12*c* and 12*d* are positioned and fixed to the first lens body 9 in a state in which the first lens body 9 is sandwiched between the pair of arm sections 12*c* and 12*d*. Accordingly, the first lens body 9 and the third lens body 12 are integrally assembled in a state in which the air layer K is provided between the incidence surface 12*a* and the emitting surface 8*a*.

Further, in the surfaces that constitute the third lens body 12, the other surfaces that are not shown or explained can be freely designed (for example, blocked or the like) within a range in which there is no bad influence on the first light L1 and the second light L2 passing through the third lens body 12.

In the lighting tool 1B for a vehicle of the embodiment having the above-mentioned configuration, the first light L1 emitted from the first light source 2 is projected by the projection lens 4 in the direction in which the vehicle advances as a passing beam (low beam). Here, the first light L1 projected toward the side in front of the projection lens 4 forms a light distribution pattern for a low beam (a first light distribution pattern) including a cutoff line defined by the boundary line S on an upper end by reversing and projecting a light source image formed in the vicinity of the focus of the synthetic lens.

Meanwhile, in the lighting tool 1B for a vehicle of the embodiment, the first light L1 and the second light L2 emitted from the first light source 2 and the second light source 3 are projected by the projection lens 4 in the direction in which the vehicle advances as a traveling beam (high beam). Here, the second light L2 projected toward the side in front of the projection lens 4 forms a second light distribution pattern disposed above a light distribution pattern for a low beam (a first light distribution pattern). The light distribution pattern for a high beam is formed by overlapping the second light distribution pattern and a light distribution pattern for a low beam (a second light distribution pattern) formed by the first light L1.

In the lighting tool 1B for a vehicle of the embodiment, the first light L1 emitted from the first light source 2 enters inside of the first lens body 9 from the first incidence section 7. Here, the first light L1 entering inside of the first lens body 9 from the first incidence section 7 is guided toward the side in front of the first lens body 9 while being condensed closer to the optical axis AX2, which is inclined downward diagonally than the optical axis AX1 of the first light L1 emitted from the first light source 2, in the vertical cross section of the lighting tool 1B for a vehicle shown in FIG. 8.

Here, the first light L11 guided toward the emitting section 8 is emitted from the emitting section 8 to the outside of the first lens body 9. Further, the first light L11 emitted to the outside of the first lens body 9 enters inside of the third lens body 12 from the incidence surface 12*a* via the air layer K and is emitted from the emitting surface 12*b* to the outside of the third lens body 12. Accordingly, the first light L11 forms a light distribution pattern below the line H-H in the light distribution pattern for a low beam LP shown in FIG. 11.

Meanwhile, the first light L12 incident on the second boundary surface T2 is guided toward the emitting section 8 after being reflected at the second boundary surface T2, and is emitted from the emitting section 8 to the outside of the first lens body 9. Further, the first light L12 emitted to the outside of the first lens body 9 enters inside of the third lens body 12 from the incidence surface 12*a* via the air layer K, and is emitted from the emitting surface 12*b* to the outside of the third lens body 12. Accordingly, the first light L12 forms a light distribution pattern in the vicinity of the cutoff line CL in the light distribution pattern for a low beam LP shown in FIG. 11.

In addition, in the lighting tool 1B for a vehicle of the embodiment, the second light L2 emitted from the above mentioned second light source 3 enters inside of the second lens body 11 from the second incidence section 10. Here, the second light L2 entering inside of the second lens body 11 from the second incidence section 10 is guided toward the side in front of the second lens body 11 while being condensed closer to the optical axis AX4, which is inclined upward diagonally than the optical axis AX3 of the second light L2 emitted from the second light source 3, in the vertical cross section of the lighting tool 1A for a vehicle shown in FIG. 8.

Among them, the second light L21 incident on the first boundary surface T1 passes through the first boundary surface T1, is guided toward the emitting section 8 after being incident into inside of the first lens body 9, and is emitted from the emitting section 8 to the outside of the first lens body 9. Further, the second light L21 emitted to the outside of the first lens body 9 enters inside of the third lens body 12 from the incidence surface 12*a* via the air layer K, and is emitted from the emitting surface 12*b* to the outside of the third lens body 12. Accordingly, the second light L21 forms a light distribution pattern above the line H-H in the light distribution pattern for a high beam HP shown in FIG. 11.

Meanwhile, the second light L22 incident on the second boundary surface T2 passes through this second boundary surface T2, is guided toward the emitting section 8 after being incident into the first lens body 9, and is emitted from the emitting section 8 to the outside of the first lens body 9. Further, the second light L22 emitted to the outside of the first lens body 9 enters inside of the third lens body 12 from the incidence surface 12*a* via the air layer K, and is emitted from the emitting surface 12*b* to the outside of the third lens body 12. Accordingly, the second light L22 forms a light distribution pattern below the light distribution pattern for a high beam HP shown in FIG. 11.

In addition, the second light L22 incident on the second boundary surface T2 approaches a position or a beam angle of the first light L12 reflected at the second boundary surface T2 when passing through the second boundary surface T2. Accordingly, since the second light L22 is emitted below the cutoff line CL of the light distribution pattern for a low beam LP, it is possible to overlap the lower section of the light distribution pattern for a high beam HP shown in FIG. 11 and the cutoff line CL of the light distribution pattern for a low beam LP each other.

As described above, in the lighting tool 1B for a vehicle of the embodiment, a good light distribution pattern for a low beam and a good light distribution pattern for a high beam can be obtained by projecting the first light L1 and the second light L2 emitted from the first light source 2 and the second light source 3 using the projection lens 4.

In addition, in the lighting tool 1B for a vehicle of the embodiment, the first lens body 9 and the second lens body 11 that constitute the projection lens 4 are joined to each other via the intermediate layer M without having the air layer present between the first boundary surfaces T1 and between the second boundary surfaces T2 by abutting the respective first boundary surface T1 and the respective second boundary surface T2 against each other while having the intermediate layer M interposed therebetween.

Accordingly, in the lighting tool 1B for a vehicle of the embodiment, it is possible to prevent occurrence of Fresnel loss at between the first boundary surfaces T1 and at between the second boundary surfaces T2, and it is possible to increase efficiency of utilization of the first light L1 and the second light L2 emitted from the first light source 2 and the second light source 3.

Further, in the lighting tool 1B for a vehicle of the embodiment, reduction in the entire thickness can be achieved by minimizing a height dimension of the projection lens 4.

In the lighting tool 1B for a vehicle of the embodiment, a function of condensing the first light L1 and the second light L2 in the vertical direction of the lighting tool 1B for a vehicle and a function of condensing the first light L1 and the second light L2 in the horizontal direction of the lighting tool 1B for a vehicle can be shared between the emitting section 8 of the first lens body 9 and the third lens body 12 by adding the third lens body 12.

Further, the present invention is not necessarily limited to the above-mentioned embodiments and various modifications may be made without departing from the scope of the present invention.

For example, in the lighting tool 1A or 1B for a vehicle, while the configuration in which the first lens body 9 and the second lens body 11 abut against each other via the intermediate layer M is provided, a configuration in which the first lens body 9 and the second lens body 11 directly abut against each other while omitting the intermediate layer M may be provided.

Further, although the lighting tool for a vehicle to which the present invention is applied is appropriately used for the above-mentioned headlight for a vehicle (headlamp), the lighting tool for a vehicle to which the present invention is not limited to the lighting tool for a vehicle on the front side and, for example, the present invention can also be applied to a lighting tool for a vehicle on the rear side such as a rear combination lamp or the like.

That is, the present invention can be widely applied to the lighting tool for a vehicle including the first light source configured to emit first light, the second light source disposed adjacent to the first light source and configured to emit second light in the same direction as the first light, and the projection lens configured to project the first light and the second light in the same direction.

In addition, the first light source and the second light source are not limited to the above-mentioned LED, and for example, may also use a light emitting element such as a laser diode (LD) or the like. In addition, color of the first light and the second light is not limited to the above-mentioned white light, and red light, orange light, or the like, can be appropriately used according to purposes thereof. Further, a configuration in which the first light source and the second light source selectively emit the first light and the second light with different colors can also be provided.

In addition, while the direction in which the first light source 2 and the second light source 3 are arranged is the vertical direction of the lighting tool 1A or 1B for a vehicle and the direction in which the boundary line S extends is the horizontal direction of the lighting tool 1A or 1B for a vehicle in the lighting tool 1A or 1B for a vehicle, the present invention may also be applied to the lighting tool for a vehicle in which the direction in which the first light source and the second light source are arranged is the horizontal direction of the lighting tool for a vehicle and the direction in which the boundary line extends is the vertical direction of the lighting tool for a vehicle.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A lighting tool for a vehicle comprising:

a first light source configured to emit first light;

a second light source that is disposed adjacent to the first light source and that is configured to emit second light in a same direction as the first light; and a projection lens configured to project the first light and the second light in a same direction, wherein the projection lens has a first lens body including a first incidence section disposed at a side facing the first light source and an emitting section disposed at a side opposite to the first incidence section, a second lens body including a second incidence section disposed at a side facing the second light source and an intermediate layer in between the first lens body and the second lens body, the emitting section of the first lens body is disposed in front of the first light source and the second light source and has an emitting surface on a side of a front surface of the first lens body, the emitting surface being constituted by a convex-lens surface, the first lens body includes a first boundary surface, which is provided between the emitting section and the second incidence section and which forms a boundary with the intermediate layer, and a second boundary surface, which is provided between the first incidence section and the second incidence section from a boundary line with respect to the first boundary surface and which forms a boundary with the intermediate layer, is provided, the second lens body includes a first boundary surface, which is provided between the emitting section and the second incidence section and which forms a boundary with the intermediate layer, and a second boundary surface, which is provided between the first incidence section and the second incidence section from a boundary line with respect to the first boundary surface and which forms a boundary with the intermediate layer, is provided, the first lens body and the second lens body have a structure in which the first boundary surface of the first lens body and the first boundary surface of the second lens body are facing each other via the intermediate layer and the second boundary surface of the first lens body and the second boundary surface of the second lens body are facing each other via the intermediate layer, the first boundary surface and the second boundary surface of the second lens body are disposed at an acute angle including the boundary line of the second lens body therebetween, a focus of the emitting surface, which is constituted by the convex-lens surface, of the first lens body, is set on the boundary line of the first lens body or in a vicinity thereof, the boundary line of the first lens body has a shape which defines a cutoff line of a first light distribution pattern while extending in a horizontal direction, among the first light that has entered inside of the first lens body from the first incidence section, a light directed forward of the first lens body is guided inside of the first lens body toward the emitting section and is emitted to an outside of the first lens body, and the first light reflected at the second boundary surface of the first lens body is emitted from the emitting section to the outside of the first lens body after being guided inside of the first lens body and forms the first light distribution pattern which includes the cutoff line defined by the boundary line of the first lens body, and among the second light that has entered inside of the second lens body from the second incidence section, the second light that has passed through the first boundary surface of the second lens body is emitted from the emitting section to the outside of the first lens body after passing through the intermediate layer and the first boundary surface of the first lens body and being guided inside of the first lens body, and the second light that has passed through the second boundary surface of the second lens body is remitted from the emitting section to the outside of the first lens body after passing through the intermediate layer and the second boundary surface of the first lens body and being guided inside of the first lens body.

2. The lighting tool for a vehicle according to claim 1, wherein a refractive index of the second lens body is smaller than a refractive index of the first lens body.

3. The lighting tool for a vehicle according to claim 2, wherein a structure in which the first lens body and the second lens body abut against each other via an intermediate layer is included, and the refractive index of the second lens body is equal to or smaller than a refractive index of the intermediate layer.

4. The lighting tool for a vehicle according to claim 3, wherein the first light projected by the projection lens forms the first light distribution pattern including the cutoff line on an upper end thereof, and the second light projected by the projection lens forms a second light distribution pattern disposed above the first light distribution pattern.

5. The lighting tool for a vehicle according to claim 2, wherein the first light projected by the projection lens forms the first light distribution pattern including the cutoff line on an upper end thereof, and the second light projected by the projection lens forms a second light distribution pattern disposed above the first light distribution pattern.

6. The lighting tool for a vehicle according to claim 5, wherein the first lens body is formed of a polycarbonate resin (PC), and the second lens body is formed of an acryl resin (PMMA).

7. The lighting tool for a vehicle according to claim 1, wherein the emitting section has a lens surface configured to condense light in a vertical direction and the horizontal direction.

8. The lighting tool for a vehicle according to claim 1, wherein the projection lens has a third lens body disposed at a side opposite to the emitting section, the emitting section has a lens surface configured to condense the first light and the second light in a direction in which the boundary line extends, and the third lens body has a lens surface configured to condense the first light and the second light emitted from the emitting section in a direction in which the first light source and the second light source are aligned.

9. The lighting tool for a vehicle according to claim 8, wherein the third lens body is integrally assembled to the first lens body in a state in which an air layer is provided between the emitting section and the third lens body.

10. The lighting tool for a vehicle according to claim 1, wherein the first light source and the second light source are provided on a same surface of a same substrate.

11. The lighting tool for a vehicle according to claim 10, wherein the first light projected by the projection lens forms the first light distribution pattern including the cutoff line on an upper end thereof, and the second light projected by the projection lens forms a second light distribution pattern disposed above the first light distribution pattern.

12. The lighting tool for a vehicle according to claim 1, wherein the first light projected by the projection lens forms the first light distribution pattern including the cutoff line on an upper end thereof, and the second light projected by the projection lens forms a second light distribution pattern disposed above the first light distribution pattern.

* * * * *